US007204766B1

(12) United States Patent
Rose et al.

(10) Patent No.: US 7,204,766 B1
(45) Date of Patent: Apr. 17, 2007

(54) GOLF SWING TRAINING APPARATUS

(75) Inventors: William R. Rose, 508 E. Morrell St., Otsego, MI (US) 49078-1338; Lee T. Edson, Hudsonville, MI (US)

(73) Assignee: William R. Rose, Otsego, MI (US)

( * ) Notice: Subject to any disclaimer, the term of this patent is extended or adjusted under 35 U.S.C. 154(b) by 48 days.

(21) Appl. No.: 11/128,594

(22) Filed: May 13, 2005

(51) Int. Cl.
*A63B 69/36* (2006.01)

(52) U.S. Cl. ..... 473/274; 473/266

(58) Field of Classification Search ..... 473/207–211, 473/216, 219, 227, 232, 257, 264, 265, 266, 473/274
See application file for complete search history.

(56) References Cited

U.S. PATENT DOCUMENTS

| | | | | |
|---|---|---|---|---|
| 2,611,610 | A | 9/1952 | Hara | |
| 3,397,892 | A | 8/1968 | Stahl | |
| 3,510,135 | A | 5/1970 | Gentile | |
| 3,698,721 | A | 10/1972 | Stewart | |
| 3,712,625 | A * | 1/1973 | Taylor | 473/274 |
| 4,583,738 | A | 4/1986 | Fava | |
| 4,659,084 | A * | 4/1987 | Vuick | 473/264 |
| 4,758,000 | A | 7/1988 | Cox | |
| 5,039,105 | A | 8/1991 | Ro | |
| 5,303,926 | A | 4/1994 | Owens et al. | |
| 5,439,226 | A * | 8/1995 | Luedtke | 473/232 |
| 5,577,729 | A * | 11/1996 | Sabour | 473/274 |
| 6,343,998 | B1 | 2/2002 | Tarulli et al. | |
| 6,533,675 | B2 | 3/2003 | Funk | |
| 6,554,716 | B1 | 4/2003 | Loh et al. | |
| 6,575,844 | B1 | 6/2003 | Gray | |
| 6,582,319 | B2 | 6/2003 | Czaja | |
| 6,595,865 | B2 * | 7/2003 | Stitz | 473/257 |
| 6,599,200 | B1 | 7/2003 | Kallassy | |
| 6,607,450 | B1 | 8/2003 | Hackman | |
| 6,612,937 | B1 | 9/2003 | Whelan | |
| 6,620,052 | B2 | 9/2003 | Piatt | |
| D486,198 | S | 2/2004 | Rohan-Weaver | |
| 6,695,710 | B2 | 2/2004 | Yamada | |
| D487,583 | S | 3/2004 | Roshala et al. | |
| 6,699,141 | B1 | 3/2004 | Florian | |
| 6,780,122 | B2 | 8/2004 | Belanger | |
| 6,843,730 | B1 | 1/2005 | Bellagamba | |
| 6,863,619 | B2 | 3/2005 | Blacklock | |

* cited by examiner

*Primary Examiner*—Nini F. Legesse
(74) *Attorney, Agent, or Firm*—Hugo A. Delevie

(57) ABSTRACT

A golf swing training apparatus includes a frame having a crosspiece interconnecting the upper ends of a pair of generally-parallel-spaced elongate supports, to thereby define a first frame portion extending along a generally horizontal first axis when the frame stands on a playing surface. Two axially-spaced, rigid cantilevered arms are mounted on the first frame section such that the free end of each arm is rotatable in a respective generally-vertical reference plane while resisting "lateral" horizontal movement. In use, the apparatus is positioned generally behind or, most preferably, generally in front of a golfer as the golfer addresses a golf ball, with each arm extending on a respective side of the golfer's head. During a swing, undesired lateral head movement is indicated by contact between the golfer's head and an arm, with the arm resisting such lateral movement to provide a proportional tactile feedback regarding such lateral head movement.

18 Claims, 2 Drawing Sheets

GOLF SWING TRAINING APPARATUS

FIELD OF THE INVENTION

The invention relates to portable training apparatus with which a golfer can practice to improve his golf swing.

BACKGROUND OF THE INVENTION

It is well known that a key to success in the game of golf is the ability to properly strike a golf ball, with the head of the golf club following an intended path when contacting the golf ball to obtain an intended trajectory or flight path, be it a high path, a low path, a straight path, a fade path, or a draw path. It is also well known that the head of a golfer denotes both his center of balance and the axis about which his body pivots to generate a desired club head speed, hence, it is important that a golfer keep his head in a fixed position during the golf swing to in order to properly strike the golf ball.

Unfortunately, the position of one's head during a golf swing is influenced by myriad factors including, for example, a proper weight distribution when first addressing the golf ball (on both flat and sloped or uneven playing surfaces), the presence of any stiffness or tension in the legs, and an improper (or lack of proper) hip and shoulder movement during the golf swing. Thus, in order to improve one's golf game, it would be advantageous to be able to detect unwanted head movement when practicing one's golf swing, for example, at a driving range, or at another suitable practice location that my beneficially further feature an uneven practice or "playing" surface.

BRIEF SUMMARY OF THE INVENTION

A golf swing training apparatus, for detecting a movement of the head of a golfer when the golfer swings a golf club while standing on a playing surface, includes a frame formed of a pair of spaced supports, and a first crosspiece bridging the two supports at or near their respective upper ends. The length of each support is preferably adjustable to accommodate uneven ground or golfers of different heights, for example, as through use of an adjustable, telescoping middle section. Each support preferably also defines a foot adapted for placement on the ground either behind or, most preferably, in front of the golfer as he addresses the ball prior to the swing. While the invention contemplates any suitable foot configuration for each support, in an exemplary embodiment, a length of generally-tubular stock is bent to form both a part of a telescoping middle section (by which to accommodate both an uneven playing surface and golfers of different height), and a generally-straight foot section (adapted for placement on the ground) disposed at an obtuse first angle relative to the middle section of the support. The obtuse first angle is preferably a fixed angle and is also preferably equal to or greater than about 110 degrees, such that the upper portions of the frame (for example, the crosspiece and the upper ends of the supports) are advantageously closer to the golfer than the lower ends of the frame (for example, the lower ends of the supports), with a reduced likelihood of contact between the golf club and the training apparatus during the ensuing swing.

In accordance with another aspect of the invention, a like second angle is defined between the nominal axis of each support, as defined, for example, by its telescoped middle section, and the nominal axis of the first crosspiece. While the invention contemplates any suitable second angle, each second angle is preferably equal to or greater than about 90 degrees, for enhanced frame stability. It will be appreciated that the foot section of each support is stabilized on the playing surface in any suitable manner, for example, as through use of stakes, or by weighing down the foot section. In an exemplary embodiment, a second, weighted crosspiece overlies the foot section of both supports to thereby lend further lateral stability to the assembled training apparatus.

In accordance with a further aspect of the invention, a first arm and, most preferably, a pair of arms are each rotatably mounted on the frame, for example, on a generally-horizontal portion of the crosspiece as the frame stands on the playing surface, such that a free end of each arm is movable within a generally-vertical reference plane when the frame stands on the playing surface while resisting movement in a direction generally normal to the reference plane. In use, one or both arms are pivoted into a noncontiguous position adjacent a respective side of the golfer's head as he addresses the golf ball (prior to swinging the golf club), to thereby define a small gap between each arm and the respective side of the golfer's head. An undesirable "lateral" movement of the golfer's head (generally perpendicular to either arm's reference plane) is thereafter indicated if the golfer's head contacts one of the arms during the swing, with the arm subsequently resisting such lateral head movement to provide a tactile indication to the golfer that his head has moved out of position.

Significantly, under the invention, when the golfer's head is in a proper position, either to one side of a single arm or in between a pair of arms, no contact is made between the golfer's head and either arm. In this manner, the training apparatus operates to inform the golfer when his head moves out of position, without otherwise applying forces to the golfer's head should his head remain properly positioned during the swing.

In accordance with yet another aspect of the invention, when the frame is positioned in front of the golfer as he addresses the golf ball prior to swinging the golf club, the first crosspiece can itself further serve to indicate an undesirable forward head movement during the swing upon contact of the golfer's head with the first crosspiece. The first crosspiece may be outfitted with a pad for this purpose. Alternatively, the golfer may beneficially rest his head against the first crosspiece, for example, when practicing a putting swing.

In accordance with yet another aspect of the invention, as noted above, the supports as well as the first crosspiece can conveniently be formed from a tubular stock, with each support being formed of a pair of L-shaped members having their respective first legs telescopingly engaging one another to thereby define an adjustable-length, generally-straight middle section of each support. The second legs of the pair of L-shaped members conveniently define the foot and upper end of the support, respectively, with the first crosspiece conveniently telescopingly engaging the upper end of each support to thereby provide the desired fixed second angle between the supports and the first crosspiece.

Finally, the arms are conveniently mounted on the first crosspiece through use, for example, of a sleeve or clamp that encompasses the first crosspiece at a selected location, thereby providing for both the required rotation of each arm's free end in their respective reference plane generally normal to the nominal axis of the tubular first crosspiece, and the required resistance to lateral movement, as well as providing for an adjustable placement of each arm on the crosspiece, relative to a selected one of the supports. The resulting exemplary light-weight, adjustable-height, rigid frame can advantageously be readily broken down to thereby enhance the portability of the training apparatus.

Other objects, features, and advantages of the present invention will be readily appreciated upon a review of the subsequent description of the preferred embodiment and the appended claims, taken in conjunction with the accompanying Drawings.

DETAILED DESCRIPTION OF THE INVENTION

Figure 1:
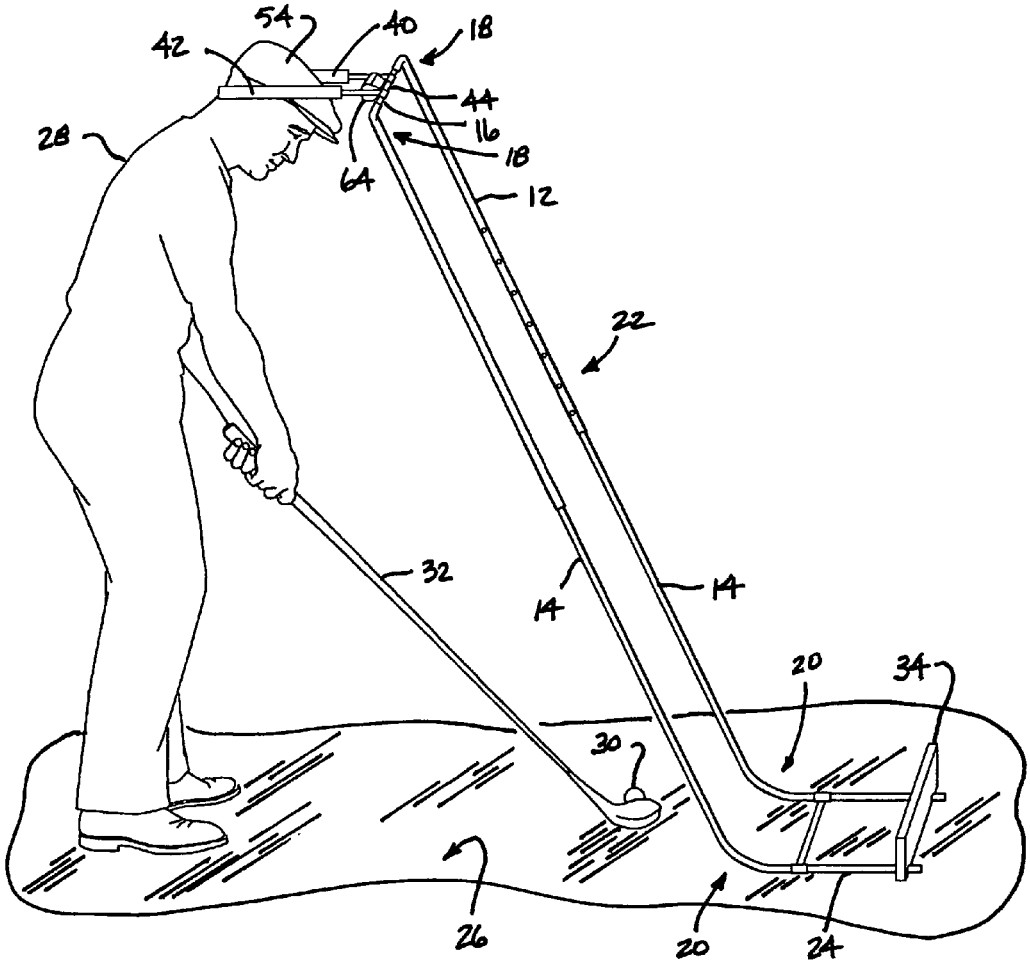
FIG. 1 is a side isometric view of an exemplary golf swing training apparatus positioned on a playing surface in front of a golfer as he prepares to swing a golf club at a golf ball supported on the playing surface.

Referring to FIG. 1, an exemplary golf swing training apparatus 10 in accordance with the invention includes a tubular frame 12 that is formed of a pair of generally-parallel-spaced elongated supports 14 bridged by a first crosspiece 16 rigidly attached to each support 14 at or near the support's upper end 18. Each support 18 includes a lower end 20 separated from the support's upper end 18 by a telescoping middle section 22, conveniently provided, for example, by forming the upper and lower portions of each support 14 from a tubular stock, such as a tubular aluminum stock. The lower end 20 of the each support 14 defines a foot 24 adapted to be positioned, for example, on a grass playing surface 26 in front of a golfer 28 as he addresses a golf ball 30 lying on the playing surface 26, prior to swinging a golf club 32 (as illustrated in FIG. 1).

Figure 2:
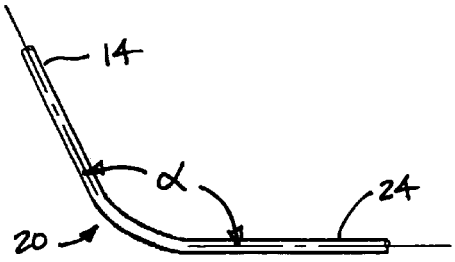
FIG. 2 is an enlarged partial side view in elevation of the lower end of one of the two spaced supports of the apparatus's frame, showing the first angle formed between the middle section of the support and the foot of the support.

While the invention contemplates any suitable foot configuration for each support 14, as best seen in FIG. 2, the exemplary training apparatus 10 features a generally-straight foot 24 disposed at an obtuse, preferably-fixed, first angle $\alpha$ relative to the generally-straight middle section 22. The obtuse first angle $\alpha$ is preferably equal to or greater than about 110 degrees, such that the upper portions of the frame 12 (for example, the first crosspiece 16 and the upper ends 18 of the supports 14) are advantageously closer to the golfer than the lower portions of the frame 12 (for example, the lower ends 20 of the supports 14), with a reduced likelihood of contact between the golf club 32 and the training apparatus 10 during the ensuing swing. The foot 24 of each support is stabilized on the playing surface 26 in any suitable manner, for example, as through use of stakes (not shown), or by weighing down each foot 24, for example, with weighted element, such as a wooden board 34 with suitably-spaced, complementary notches, overlying each foot 24, as illustrated in FIG. 1.

Figure 3:
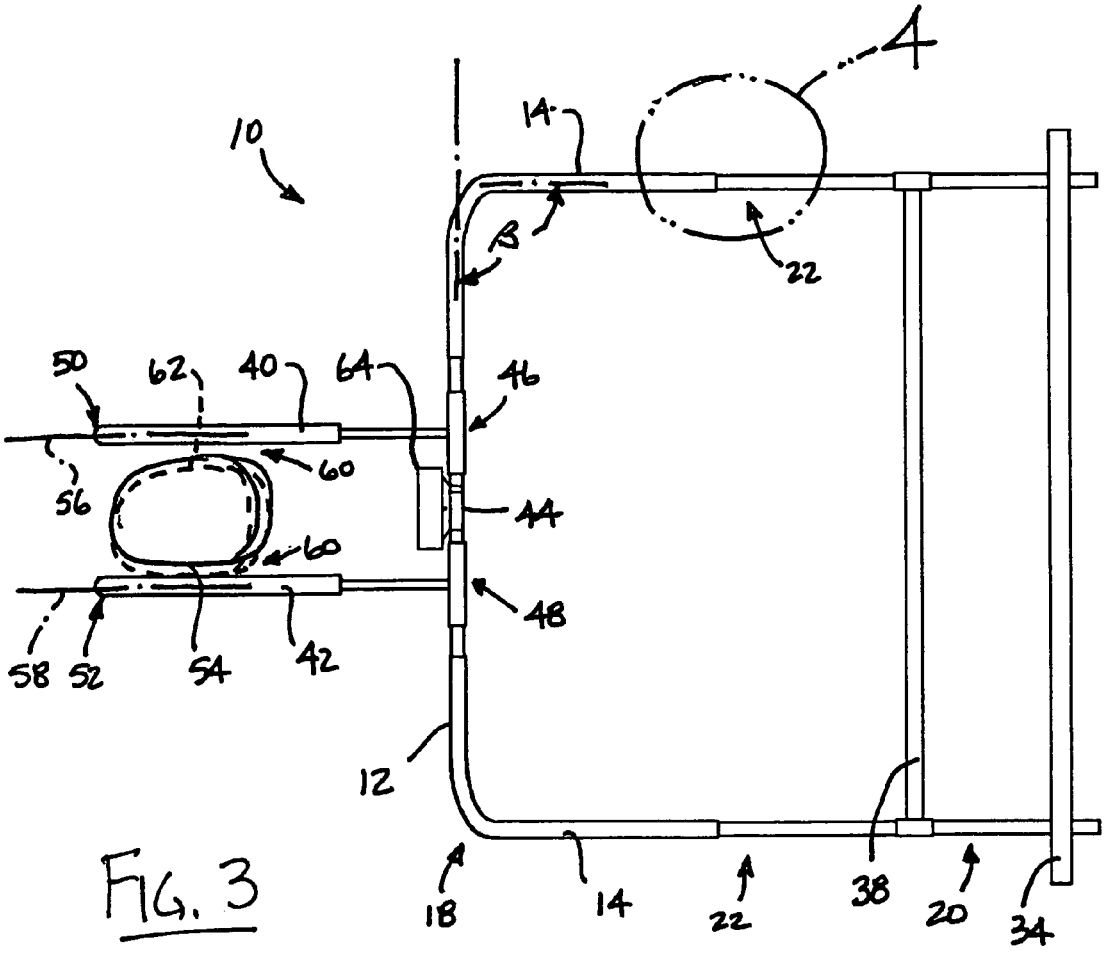
FIG. 3 is a plan view of the exemplary golf swing training apparatus illustrated in FIG. 1, without the optional forehead pad and showing only the golfer's capped head for clarity of illustration (a stationary head being illustrated in solid lines, and a moving head being illustrated in broken lines)

As best seen in FIG. 3, the training apparatus 10 also features a preferably-fixed second angle $\beta$ of roughly 90 degrees defined between the middle section 22 of each support 14 and the nominal axis 36 of the first crosspiece 16. Preferably, the second angle $\beta$ is equal to or greater than about 90 degrees, for enhanced frame stability. A second crosspiece 38, preferably bridging the supports 14 at or near their respective lower ends 20, provides enhanced stability to the frame 12.

As seen in FIGS. 1 and 3, a pair of cantilevered, generally rigid arms 40,42 are rotatably mounted on a central portion 44 of the first crosspiece 16 that is generally horizontal when the frame 12 is positioned on the playing surface 26, for example, by adjusting the length of telescoping middle section 22 of one or both supports 14. More specifically, the first arm 40 is mounted to the first crosspiece 16 at a first pivot point 46. The second arm 42 is mounted on the first crosspiece 16 at a second pivot point 48 that is axially spaced from the first pivot point 46. Preferably, the location of the second pivot point 48 on the first crosspiece 16 is preferably adjustable relative to one of the supports 14 (and, hence, relative to the first arm 40) to thereby accommodate golfers whose heads are of different sizes.

The free end 50,52 of each arm is movable within a respective reference plane 56,58 generally perpendicular to the nominal axis 36 of the first crosspiece 16. Thus, with the height of one or both supports 14 adjusted such that the central portion 44 of the first crosspiece 16 is generally horizontal when the frame 12 stands on the playing surface 26, each arm 40,42 resists movement in a direction generally normal to its respective, generally-vertical reference plane 56,58, i.e., resists horizontal or "lateral" movement.

As seen in FIG. 1, in use, one or both arms 40,42 of the training apparatus 10 are pivoted into a noncontiguous position adjacent a respective side of the golfer's head 54 as he addresses the golf ball 30 prior to swinging the golf club 32, to thereby define a small gap 60 between each arm 40,42 and the respective side of the golfer's head 54 (the gaps 60 being best seen in FIG. 3). An undesirable "lateral" movement of the golfer's head 54, i.e., head movement generally perpendicular to either arm's reference plane 56,58 during the swing is thereafter indicated by contact between one side of the golfer's moving head 62 and one of the arms 40,42, with the arm 40,42 subsequently resisting such lateral head movement to provide a tactile indication to the golfer 28 that his head has moved out of position during the swing. The free ends 50,52 of each arm 40,42 are preferably padded for increased player comfort, while use of a resilient padding material can advantageously provide a calibrated tactile feedback, should the golfer's head 54 contact either arm 40,42 during the swing.

Significantly, under the invention, when the golfer's head 54 is in a proper position (either to one side of a single arm 40,42, or in between a pair of arms 40,42), no contact is made between the golfer's head 54 and either arm 40,42, as illustrated in FIG. 3. In this manner, the training apparatus 10 operates to inform the golfer 28 when his head 54 moves out of position (as shown in broken lines 62), without otherwise applying forces to the golfer's head 54 when his head 54 remains properly positioned during the club swing.

Referring again to FIG. 1, with the frame 12 positioned in front of the golfer 28 as he addresses the golf ball 30 prior to swinging the golf club 32, the first crosspiece 16 can itself further serve to indicate an undesirable forward head movement during the swing upon contact of the golfer's head 54 with the first crosspiece 16. The first crosspiece may be outfitted with a pad 64 for this purpose (shown only in FIG. 1 for clarity of illustration). Alternatively, the golfer 28 may beneficially practice reducing undesirable fore-aft head movement, for example, when practicing a putting swing, by resting his head 54 against the first crosspiece 16 or the pad 64, with the undesirable head movement being indicated either by increased tactile feedback (responsive to a forward head movement during the swing) or an ensuing absence of contact between the golfer's forehead and the first crosspiece 16 or the pad 64.

Figure 4:
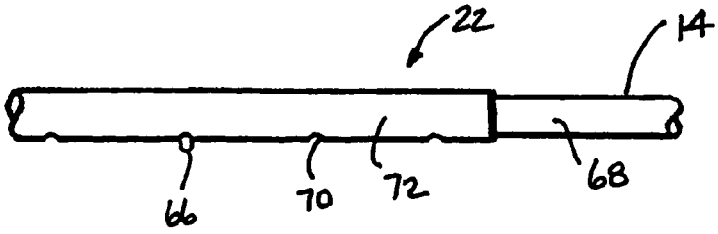
FIG. 4 is an enlarged partial view of the telescoped, middle section of one of the supports, within circle 4 of FIG. 3.

As seen in FIGS. 1 and 3, in the exemplary training apparatus 10, the supports 14 and each crosspiece 16,38 are conveniently formed from a tubular stock, with each support 14 further being formed of a pair of L-shaped members having their respective first legs telescopingly engaging one another to thereby define the adjustable-length, generally-straight middle section 22 of each support 14. And, as best shown in FIG. 4, a spring-loaded detent or pin 66, housed within the telescopically-inner tube 68 and projecting into a selected complementary aperture 70 formed in the telescopically-outer tube 72, conveniently provides the desired adjustability to the length of the support 14, to thereby accommodate uneven ground and/or golfers of differing heights. The second legs of the pair of L-shaped members conveniently define the foot 24 and upper end 18 of the support 14, respectively, with the first crosspiece 16 conveniently being telescopingly received within the upper end 18 of each support 1.

Finally, the arms 40,42 are conveniently mounted on the first crosspiece 16 through use, for example, of a sleeve or clamp that encompasses the first crosspiece 16 at their respective pivot points 44,46 and permits rotationally locking each arm 40,42 in a selected position within its reference plane 56,58, for example, to thereby accommodate the height of a given golfer. In this manner, an exemplary rigid, light-weight, adjustable-height frame 12 is provided that can advantageously be readily broken down to thereby enhance the portability of the training apparatus 10.

While the above description constitutes the preferred embodiment, it will be appreciated that the invention is susceptible to modification, variation and change without departing from the proper scope and fair meaning of the subjoined claims. For example, while the exemplary apparatus 10 is illustrated as being positioned directly in front of the golfer 28 as he addresses the golf ball 30, prior to swinging the golf club 32, it will be appreciated that the invention contemplates positioning the apparatus 10 immediately behind the golfer 28 as he addresses the golf ball 30, with at least one arm 40,42 in close-spaced juxtaposition with a respective side of the golfer's head 54 to thereby provide the intended tactile feedback, should the golfer 28 move his head 54 laterally into the arm 40,42 during the ensuing golf club swing.

What is claimed is:

1. A golf training apparatus for use in detecting a movement of the head of a golfer when the golfer swings a golf club while standing on a surface, the training apparatus comprising:

a frame including:

a pair of spaced elongated supports, each support having an upper end, a middle portion, and a lower end, wherein the lower end of each support is adapted for placement on the surface, and a first crosspiece bridging the supports, the first crosspiece being rigidly attached to each support proximate to the upper end of the support, respectively, the frame extending away from the golfer when the golfer swings the golf club such that the frame makes no contact with the golfer during the swing; and a first generally-rigid arm having a first end and a second end, the first end of the first arm being rotatable mounted to the frame such that the second end is movable within a generally-vertical first reference plane when the lower end of each support is placed on the surface while resisting movement in a direction perpendicular to the first reference plane, wherein the middle portion of one support includes a generally-straight first section, and wherein the lower end of the one support includes a generally-straight second section defining a foot disposed at an obtuse first angle relative to the first section.

2. The training apparatus of claim 1, wherein the first angle is equal to or greater than about 110 degrees.

3. The training apparatus of claim 1, wherein one of the supports of the frame adjusts to accommodate an uneven surface.

4. The training apparatus of claim 3, wherein the middle portion of one support includes an adjustable-length telescoped section.

5. The training apparatus of claim 1, wherein the first arm is mounted to the first crosspiece at a first pivot point, and wherein the location of the first pivot point on the first crosspiece is adjustable relative to one of the supports.

6. The training apparatus of claim 5, wherein the first crosspiece defines an axis, and further including a second generally-rigid arm having a first end and a second end, the first end of the second arm being mounted on the first crosspiece at a second pivot point such that the second arm is movable within a generally-vertical second reference plane when the lower end of each support is placed on the surface while resisting movement in a direction perpendicular to the second reference plane.

7. The training apparatus of claim 6, wherein the location of the second pivot point on the first crosspiece is adjustable relative to one of the supports.

8. The training apparatus of claim 1, further including a second crosspiece bridging the supports, the second crosspiece overlying each support proximate to the lower end of the support, respectively.

9. A golf training apparatus for use in detecting a movement of the head of a golfer when the golfer swings a golf club while standing on a playing surface, the training apparatus comprising:

a frame including:

a pair of spaced elongated supports, each support having an upper end, a generally-straight middle section, and a lower end defining a foot adapted for placement on the surface, and a first crosspiece attached to each support proximate to the upper end of the support, respectively, the first crosspiece defining a generally-horizontal first portion of the frame when the foot of each support rests on the playing surface, the frame extending away from the golfer when the golfer swings the golf club such that the frame makes no contact with the golfer during the swing; and a first generally-rigid arm rotatable mounted to the first portion of the frame such that a free end of the first arm is movable within in a first generally-vertical reference plane into a noncontiguous position adjacent one side of the head of the golfer as the golfer addresses the golf ball, while resisting movement in a first direction perpendicular to the first reference plane to thereby apply a resistive force to the head of the golfer in response to a movement of the head into the first arm when the golfer swings the golf club, wherein the foot of each support is disposed at fixed obtuse first angle relative to the middle section.

10. The training apparatus of claim 9, wherein the first angle is equal to or greater than about 110 degrees.

11. The training apparatus of claim 9, wherein one of the supports of the frame adjusts to accommodate an uneven surface.

12. The training apparatus of claim 9, wherein the middle section of one of the supports has an adjustable length.

13. The training apparatus of claim 9, wherein the lower end of each support is adapted to be positioned on the surface in front of the golfer when the golfer swings the golf club.

14. The training apparatus of claim 9, further including a second generally-rigid arm having a first end and a second end, the first end of the second arm being mounted on the first crosspiece at a second pivot point such that the second end of the second arm is movable within in a second generally-vertical reference plane into a noncontiguous position adjacent another side of the head of the golfer as the golfer addresses the golf ball, while resisting movement in a second direction perpendicular to the second reference plane to thereby apply a resistive force to the head of the golfer in response to a movement of the head into the second arm when the golfer swings the golf club, the second pivot point being spaced from the first pivot point.

15. A golf training apparatus for use in detecting a movement of the head of a golfer when the golfer swings a golf club while standing on a surface, the training apparatus comprising:

a frame including:

a pair of spaced elongated supports, each support having an upper end, a middle portion, and a lower end, wherein the lower end of each support is adapted for placement on the surface, a first crosspiece bridging the supports, the first crosspiece being rigidly attached to each support proximate to the upper end of the support, respectively, and a second crosspiece bridging the supports, the second crosspiece overlying each support proximate to the lower end of the support, respectively, the frame extending away from the golfer when the golfer swings the golf club such that the frame makes no contact with the golfer during the swing; and a first generally-rigid arm having a first end and a second end, the first end of the first arm being rotatable mounted to the frame such that the second end is movable within a generally-vertical first reference plane when the lower end of each support is placed on the surface while resisting movement in a direction perpendicular to the first reference plane.

16. A golf swing training apparatus for use in detecting a movement of the head of a golfer when the golfer swings a golf club after addressing a golf ball supported by a playing surface, the training apparatus comprising:

a frame including:

a pair of spaced elongated supports, each support including two generally-L-shaped tubular members, wherein the first tubular member includes a first leg and a second leg disposed at a fixed obtuse first angle with respect to the first leg, the second tubular member includes a first leg and a second leg disposed at a second angle with respect to the first leg, and the respective first legs of each pair of first and second tubular members telescopingly engage to form a middle section of each support of a desired length, the second leg of each first tubular member thereby defines a respective lower end of each support adapted to rest on the playing surface, and the second leg of each second tubular member thereby defining a respective upper end of each support, and a first crosspiece bridging the opposed upper ends of the supports, wherein the crosspiece defines a first axis, the frame extending away from the golfer when the golfer swings the golf club such that the frame makes no contact with the golfer during the swing;

a first generally-rigid arm rotatably mounted to the crosspiece at a first pivot point such that a free end of the first arm moves within in a first reference plane generally normal to the first axis while resisting movement in a first direction parallel to the first axis; and a second generally-rigid arm rotatably mounted to the crosspiece at a second pivot point such that a free end of the second arm moves within a second reference plane generally normal to the first axis while resisting movement in a second direction parallel to the first axis, the second arm being axially spaced from the first arm, the second pivot point being adjustably spaced from the first pivot point, and the second direction being opposite the first direction, whereby the arms apply a resistive force to the head of the golfer when the head moves axially into contact with one of the arms during the swing.

17. The training apparatus of claim 16, wherein the first angle is equal to or greater than about 110 degrees.

18. The training apparatus of claim 16, further including a second crosspiece bridging the lower ends of the supports.

* * * * *